US008616285B2

(12) United States Patent
Tinker et al.

(10) Patent No.: US 8,616,285 B2
(45) Date of Patent: Dec. 31, 2013

(54) STEP RATCHET FRACTURE WINDOW SYSTEM

(75) Inventors: Donald W. Tinker, Rapid City, MI (US); Michael T. Sommers, Beggs, OK (US)

(73) Assignee: Team Oil Tools LP, The Woodlands, TX (US)

( * ) Notice: Subject to any disclaimer, the term of this patent is extended or adjusted under 35 U.S.C. 154(b) by 298 days.

(21) Appl. No.: 12/980,021

(22) Filed: Dec. 28, 2010

(65) Prior Publication Data

US 2011/0203800 A1 Aug. 25, 2011

Related U.S. Application Data

(60) Provisional application No. 61/290,300, filed on Dec. 28, 2009.

(51) Int. Cl.
*E21B 34/06* (2006.01)

(52) U.S. Cl.
USPC ..... 166/334.4; 166/177.5; 166/318; 166/373

(58) Field of Classification Search
USPC ..... 166/177.5, 318, 332.4, 334.4, 373
See application file for complete search history.

(56) References Cited

U.S. PATENT DOCUMENTS

| | | | | |
|---|---|---|---|---|
| 4,893,678 | A | 1/1990 | Stokley et al. | |
| 6,679,336 | B2 | 1/2004 | Musselwhite et al. | |
| 6,695,066 | B2 | 2/2004 | Allamon et al. | |
| 6,959,766 | B2 | 11/2005 | Connell | |
| 7,152,688 | B2 | 12/2006 | Richards | |
| 7,387,165 | B2 | 6/2008 | de Gardenas et al. | |
| 7,416,029 | B2 * | 8/2008 | Telfer et al. | 166/386 |
| 7,503,392 | B2 | 3/2009 | King et al. | |

* cited by examiner

*Primary Examiner* — William P Neuder
*Assistant Examiner* — Richard Alker
(74) *Attorney, Agent, or Firm* — Lee, Jorgensen, Pyle & Kewalramani, PC

(57) ABSTRACT

The present invention is to an internal sleeve slidably received within a tubular housing. The sleeve and outer housing have windows that selectively align. Movement of the sleeve within the housing is controlled by a ball passing through the interior of the sleeve to activate a ratchet that allows the sleeve to move a set amount under the influence of a spring. A split seat at a lower end of the housing traps after a set number of balls have passed through the housing. A number of similar tools can be used to provide openings at various points that include coordinated ratchet steps so that only one tool at a time opens for fracturing or other purposes. A reverse flow causes a ball to impinge upon the next higher ball seat and thereby opening the seat to provide a full bore flow passage through the tool.

20 Claims, 3 Drawing Sheets

STEP RATCHET FRACTURE WINDOW SYSTEM

CROSS REFERENCE TO RELATED APPLICATIONS

This application claims the benefit of U.S. Provisional Application 61/290,300, filed Dec. 28, 2009, entitled Step Ratchet Fracture Window System, which is incorporated herein by reference.

BACKGROUND OF THE INVENTION

Field of the Invention

The present application relates to an internal sleeve slidably received within a tubular housing of a down hole window tool.

SUMMARY OF THE INVENTION

The present invention uses an internal sleeve slidably received within a tubular housing. The sleeve and outer housing have windows that selectively align. Movement of the sleeve within the housing is controlled by a ball passing through the interior of the sleeve to activate a ratchet that allows the sleeve to move a set amount under the influence of a spring. A split seat at a lower end of the housing traps after a set number of balls have passed through the housing. A number of similar tools can be used to provide openings at various points that include coordinated ratchet steps so that only one tool at a time opens for fracturing or other purposes. A reverse flow causes a ball to impinge upon the next higher ball seat and thereby opening the seat to provide a full bore flow passage through the tool.

Accordingly, it is a principal object of a preferred embodiment of the invention to provide a downhole tool that can be activated and deactivated by a ball dropped through the tool It is another object of the invention to provide a down hole tool that has a ratchet so that a number of downhole tools can be activated or deactivated in sequence.

It is a further object of the invention to provide a down hole tool having a ball seat that allows a ball to selectively pass through the seat until activated to block further flow through the valve seat Still another object of the invention is to provide a downhole tool that has a valve seat body that can be activated by a reverse flow and/or a ball to reverse the ratchet one step to provide full bore flow through the tool.

It is an object of the invention to provide improved elements and arrangements thereof in an apparatus for the purposes described which is inexpensive, dependable and fully effective in accomplishing its intended purposes.

These and other objects of the present invention will be readily apparent upon review of the following detailed description of the invention and the accompanying drawings. These objects of the present invention are not exhaustive and are not to be construed as limiting the scope of the claimed invention. Further, it must be understood that no one embodiment of the present invention need include all of the aforementioned objects of the present invention. Rather, a given embodiment may include one or none of the aforementioned objects. Accordingly, these objects are not to be used to limit the scope of the claims of the present invention.

BRIEF DESCRIPTION OF THE DRAWINGS

Similar reference characters denote corresponding features consistently throughout the attached drawings.

DETAILED DESCRIPTION OF THE PREFERRED EMBODIMENT(S)

The present invention according to at least one aspect is to a downhole tool having a ball and ratchet device for activating and deactivating a window on the tool for well processes such as fracturing and production without having to run the tool out of the hole to change the mode of the tool.

Figure 1:
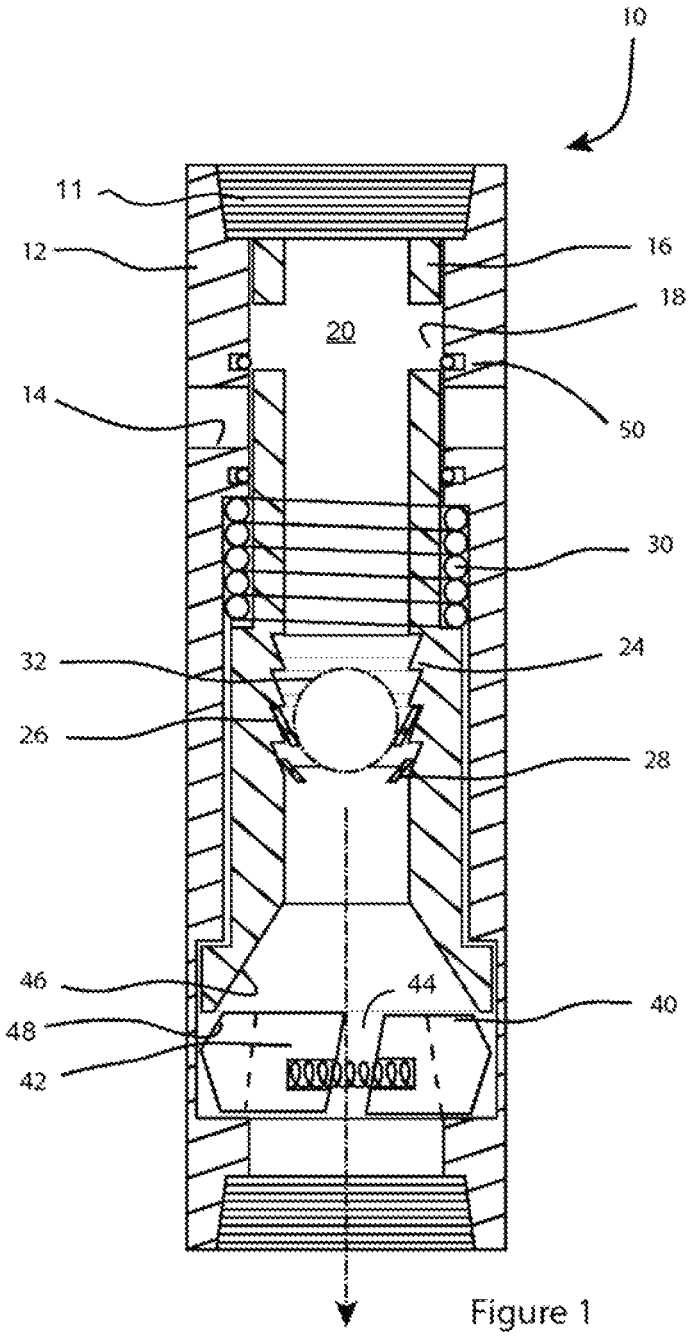
FIG. 1 is an exemplary embodiment of a downhole tool showing at least one aspect of the invention.

FIG. 1 shows a downhole tool 10 for providing a selectively openable lateral window. The tool 10 has an outer housing 12, preferably having a tubular outer configuration to slide within a borehole casing (not shown). The tool has appropriate threading 11 or other connectors at an upper surface so that it may be run in with a length of tubing or other device. The housing 12 has at least one lateral opening 14 which may be blocked or unblocked by an inner sleeve 16 having an appropriately configured opening 18, which allows access to an inner portion 20 of the sleeve. The inner chamber 20 of the sleeve 16 is preferably in fluidic communication with the surface through the length tubing (not shown) attached at an upper end of the tool 10.

In operation, the inner sleeve 16 is set to a preferred orientation ("offset") relative to the outer housing 12. Typically, the window 18 of the inner sleeve will be offset from the window 14 of the outer housing so that there is no communication between the borehole outside of the outer housing and the chamber 20 inside the inner sleeve. The inner sleeve 14 maintains its position relative to the housing 10 by a ratchet mechanism that includes a number of ratchet grooves 24 in the inner sleeve, which determines the number of steps possible in the ratchet, and a number of ratchet pawls.

The pawls in the mechanism preferably include a number of load pawls 26 which are normally in contact with the ratchet grooves to hold the inner sleeve in place relative to the housing against the load of a spring 30. These pawls are connected to the outer housing so that they maintain their position relative to the housing as the inner sleeve moves relative to the pawls.

To prevent an unplanned movement of the inner sleeve under the force of the spring 30 while the load pawl is released, one or more ratchet pawls 28 may be used. These pawls are preferably one half step off of the load pawls, that is, while the load pawls are in the open mode (i.e., retracted away from groove 24), the ratchet pawls are still in expanded contact with the sidewall groove 24 so that the next groove on the inner sleeve cannot advance past the ratchet pawl, but the ratchet can move far enough so that when the load pawl expands again, it will slide into the next adjacent groove to advance one step when the ratchet pawl is subsequently expanded. In this way as the load pawl and then ratchet pawl are sequentially retracted by a ball 32 or other device, the spring 30 will move the inner sleeve 16 one step under the constrained guidance of the load pawl(s) 26 and ratchet pawl(s) 28.

When a ball is introduced into the inner sleeve of the tool, the ball will activate the ratchet will advance one step as described above to move the inner sleeve 16 one step down relative to the housing 12. The number of grooves and their spacing will determine the total relative movement between the inner sleeve and outer housing and will determine the number of balls that will need to be introduced to move the inner sleeve a certain distance. One skilled in the art would appreciate that the relative length of the ratchet steps will determine the length of travel of the inner sleeve. Preferably the window 18 will be completely sealed from opening 14 in one ratchet position and in complete alignment in the next ratchet position.

One purpose of this relative movement is to bring the window 18 into alignment with window 14. (See FIG. 4) By being able to remotely determine the exact position of the inner sleeve relative to the outer housing by counting the number of balls dropped through the tool, a user on the surface will know whether the windows are in alignment or out of alignment. In this way, a set number of balls can be dropped to align the windows without having to raise the equipment to the surface for manual manipulation. If a number of these tools are provided downhole, then each tool can be provided with a different number of steps ("balls") until opening. Each tool may then be sequentially opened with each ball dropped (or a particular number of balls). For example, the first ball may open the bottom most tool 110 (FIG. 2), and then second ball may open the next higher tool 120, the third ball the next higher tool 130, etc.

Figure 4:
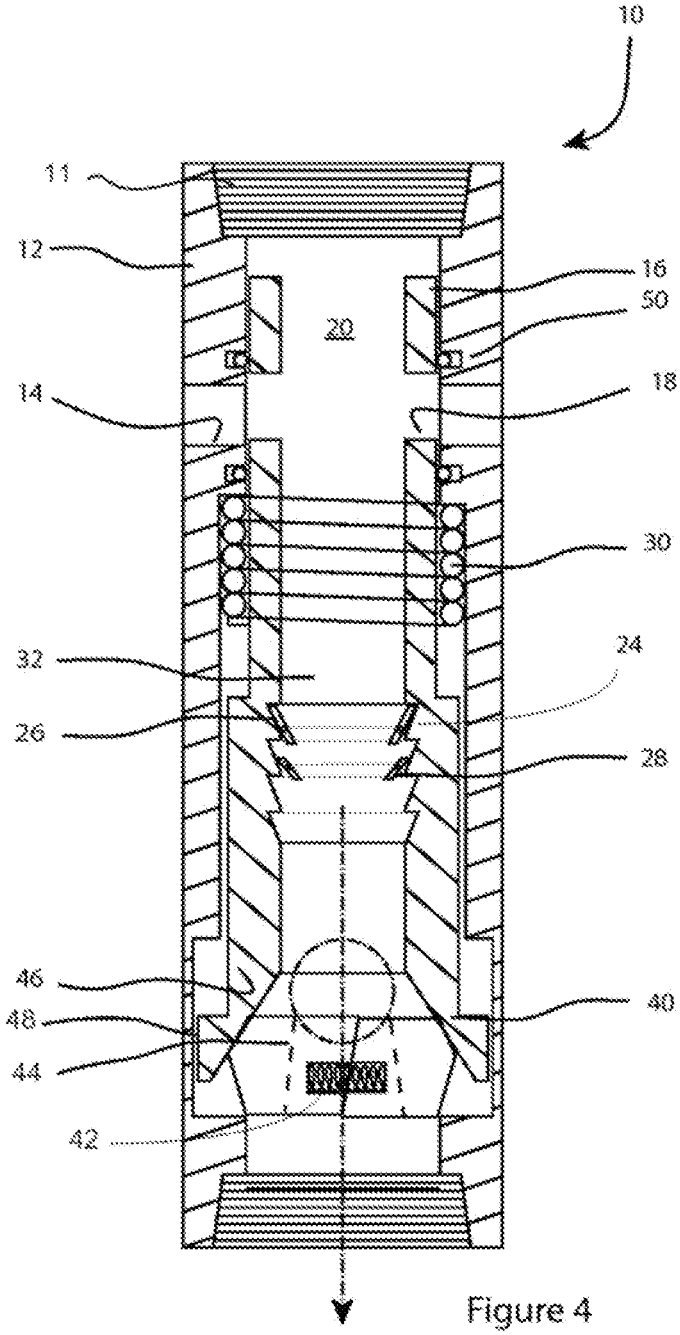
FIG. 4 shows a downhole tool with the windows aligned.

A split valve seat 40 is preferably provided at a lower end of the tool 10 as shown in FIG. 1. The valve seat has two halves kept apart by a spring 42. The spring spreads the valve seat halves apart a sufficient distance to allow the triggering ball 32 to pass through to the next tool through a passageway 44 defined in the valve seat. In this way one ball can trigger the ratchet on each tool that it passes through. A lower surface 46 on the inner sleeve is preferably slanted to mate with and engage an outer slanted surface 48 on the valve seat 40. As the inner sleeve moves downward in steps as directed by the ratchet mechanism, the sleeve lower surface 46 moves downward pressing upon and interfering with the valve seat positioning. The slanted surfaces cooperate to cause the valve seat halves to move towards each other compressing the spring 42. When the sleeve lower surface has moved down a sufficient amount, the compression causes the passageway 44 to be reduced to an area smaller than the cross-section of the triggering ball 32. When the passageway is too small for the ball to pass through, the ball will seat on valve seat 40 blocking flow therethrough (FIG. 4). Preferably the ball and seat are sized and shaped to prevent any flow through the bottom of the tool 10. Flow through the tool will now be forced out the aligned windows 14, 18. If the tool is aligned with a lateral window in the borehole casing, the flow can be directed through to a lateral bore, for example, to direct fluid outward to frac ("fracture" or "the process of forcing specially blended fluids or other materials into a hole to increase the size of ('crack open') fractures in a wellbore to enhance potential flow rates through the resulting passages") the lateral bore. The use of multiple tools set apart for example by 100 feet will allow multiple zones to be fractured sequentially without having to run the tool out of the borehole between operations.

The passageway 44 may have a slightly larger diameter at the bottom than the top. This is preferably provided to assist in deactivating a tool. When a procedure is completed in one zone, the windows can be "shut" by reversing the movement of the inner sleeve 16. A reverse flow will cause a ball below a tool to flow upward to the bottom of a valve seat 40. Since the valve seat passageway 44 is too small to allow a ball to pass through, the ball will stop in the valve seat. The fluid pressure upward will build up forcing the ball against the seat. When the pressure is sufficient, the ball will force the valve seat halves apart as the ball moves against the slanted walls of the passageway 44 until the ball is allowed to pass through.

The outward movement of the valve seat will displace the lower surface 46 of the inner sleeve forcing the sleeve upward. The ratchet is preferably a one way lock, allowing the sleeve to move freely against the ratchet. The spring 30 is typically sufficient to prevent unintended movement of the inner sleeve upwardly relative to the housing 12. As the pressure of the valve seat against the lower sleeve surface forces the inner sleeve upward, the motion will preferably move the inner sleeve up at least one step before the ball can pass through the valve seat so that the ratchet will hold the inner sleeve in the new position, that is one step backwards. The movement of the sleeve is preferably sufficient to misalign the windows 16,18 enough such that the inner chamber 20 is now sealed from the area surrounding the outer housing. Seals 50 such as o-rings or other devices may be used to help seal the inner chamber from the area outside the tool when the windows are not in alignment.

Figure 3B:
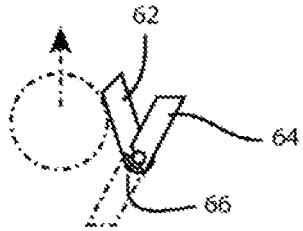
FIGS. 3A & 3B show a collapsible ratchet for use with at least one embodiment of the invention.
Figure 3A:
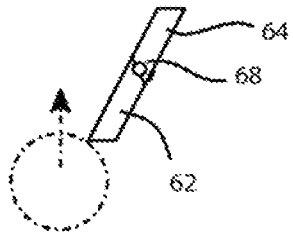

The ratchets pawls 26,28 are preferably configured to allow the ball to pass upward through the ratchet and through the tool. One such method for allowing the ball to pass is show in FIGS. 3A and 3B. One or more of pawls may be configured in two parts, namely an outer arm 62 and an inner arm 64 attached by a spring and/or rotational arm 66. The inner arm is configured to rest within a groove 24. The outer arm extends into the inner chamber to activate the ratchet mechanism as the ball moves downwardly through the chamber 20. This same interference between the ball and pawl causes the preferred activation of the ratchet in one direction but interferes with the free travel of the ball 32 in the other direction. Therefore, the pawl may need to collapse or otherwise get out of the way of an upward traveling ball.

To accomplish this, the pivot arm may be centered about a pivot 68 or may be outwardly therefrom. When the ball moves upward through the tool, it may impinge upon the outer arm extending into the inner chamber 20. The spring loaded arm is thus configured to rotate ("fold over") so that the arm moves out of the way as the ball passes. The arm is however configured such that it cannot fold in other direction (e.g., when the ball passes downwardly), but instead causes the pawl to rotate about the pivot 68 to cause the ratchet motion as described above under the force of the triggering ball 32. The rotating arm 66 is connected to the outer arm and when the ball presses down on the outer arm 62, the rotating arm presses on the underside of the inner arm and is thus prevented from collapsing.

Figure 2:
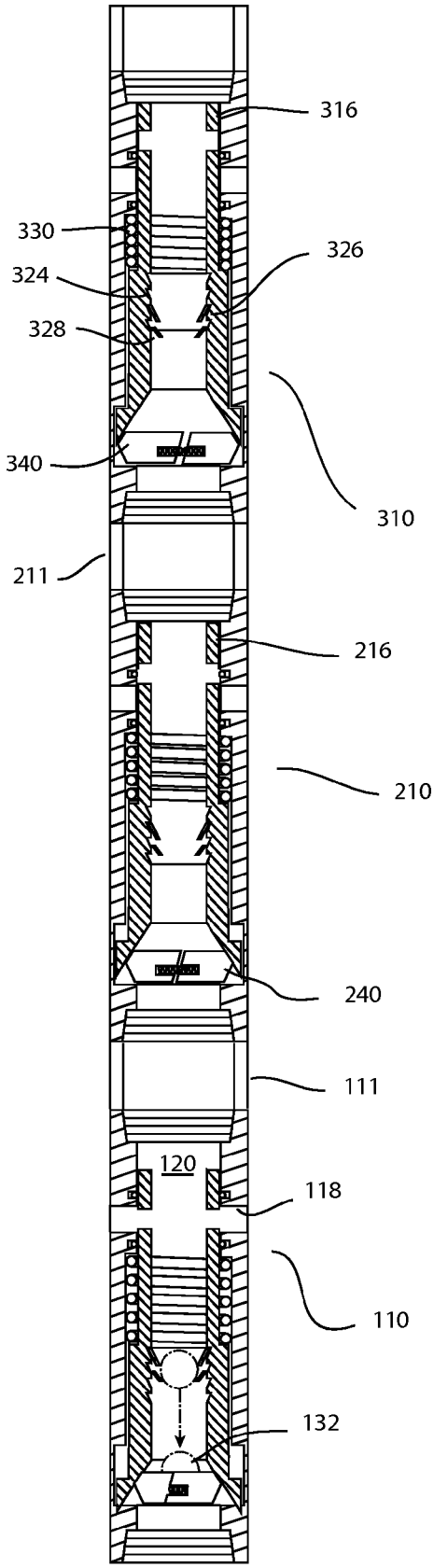
FIG. 2 shows a plurality of downhole tools according to a preferred embodiment of the invention.

FIG. 2 shows a preferred embodiment of a plurality of downhole tools attached together and ready for insertion downhole. Each downhole tool 110,210,310 is connected by a length of tubing 111,211, preferably separating each tool by about 100 feet. A number of packers (not shown) or other seals may be provided in the separating tubing 111,211 to create separate zones for each tool.

The tools are lowered into a well bore by a length of tubing (not shown) sufficient to lower the tool to the desired distance. Preferably the outer casing into which the tools are lower have pre-weakened areas (not shown) adjacent the windows 14, 18 (FIG. 1) on the tools to facilitate lateral drilling, but this is not necessary for the present invention Preferably, lateral drilling has already occurred and the casing is open to a lateral well bore adjacent the window 118 or at least with the zone serviced by the tool.

Each tool has a ratchet preconfigured with the pawls 326, 328 in the proper groove 324 such that the tool will align the windows in the proper sequence. These tools allow each sleeve to operate independent under the effects of its own ratchet, but it is also envisioned to operate more than window from one ratchet For illustration purposes, the three tools 110,210,310 are shown in various stages of setting. The uppermost tool 310 shows the pawls 326,328 several steps from being fully activated. A ball dropped through the tubing will activate the ratchet to move the inner sleeve 316 down one step as discussed above. Fluid pressure may be used to assist the ball in dropping from from the surface to the tool. When the ratchets are retracted by the ball, the ratchets move up one groove as the sleeve is forced downward by spring 330.

The tool 310 will move to the positioning illustrated in tool 310. However, as the ball continues to drop after passing the ratchet pawl(s) 328, the ball will pass through valve seat 340, since valve seat 340 has not compressed in this state far enough to fully interfere with the passage of the ball. The ball will then pass through the tubing 211 to the next lower tool 210.

The ball passing through tool 210 will activate its ratchet and cause the inner sleeve to move one step downward and compress the valve seat one step. This will move the tool 210 from the illustrate state to the state shown in tool 110.

Tool 110 shows the windows fully activated and aligned. Chamber 120 is now in communication with the area laterally outside the tool through the windows 14,18 (FIG. 1). As the ball passed through tool 110 to activate the windows, the valve seat will have collapsed a sufficient amount to capture the ball 132 on to the valve seat 140 to shut off further flow through the tool. Any flow will now be directed outward through the window.

When the zone has been treated by fracturing or other procedure, the windows may be closed by reversing the flow of fluids. Flow reversal causes a ball from a lower zone to move upward through the next higher tool. This may require deflating packers (not shown) and/or inflation or insertion of other seals to promote flow in the desired direction. The lower most tool may be left open or closed by a different method or by a ball received in a chamber below the lowermost tool for such purpose. The ball will open the valve seat 240 of the next higher tool causing the inner sleeve 216 to move upward as discussed above. The ball when then flow upward. Since the higher levels likely do not have an interfering valve seat, the ball should flow freely to the surface passing the fingers of the pawls as described with reference to FIG. 3.

In an alternative embodiment, it may be desired to have the windows stay in alignment after the ball flows upward through the tool instead of closing as the inner sleeve moves up one step to provide full bore flow through all of the zones.

In a separate embodiment, different sized balls may be used to address a particular tool by having the pawls configured to only activate when a ball of a particular size or larger is sent through the tool. In this embodiment, smaller balls are preferably used to activate lower tools and larger balls to address higher tools. Additionally, a further ratchet step could reopen the valve or reclose the inner chamber lateral window.

In a further embodiment, instead of capturing a ball on a valve seat, the final ball may cause a flapper valve or other valve to activate to close a lower end of the tool or portions of the split valve to seal together to cause a valving action. A ball rising through the tool could then cause the same closed valve to open, for example by causing the inner sleeve to reverse one step to allow the valve to open.

While this invention has been described as having a preferred design, it is understood that it is capable of further modifications, uses and/or adaptations of the invention following in general the principle of the invention and including such departures from the present disclosure as come within the known or customary practice in the art to which the invention pertains and as maybe applied to the central features hereinbefore set forth, and fall within the scope of the invention and the limits of the appended claims. It is therefore to be understood that the present invention is not limited to the sole embodiment described above, but encompasses any and all embodiments within the scope of the following claims.

We claim:

1. A downhole tool, comprising:

a cylindrical outer sleeve defining an axial bore therethrough and at least one lateral opening on the other circumference of the cylindrical outer sleeve;

an inner sleeve slidably disposed coaxially within the axial bore of the outer sleeve and defining an inner chamber and at least one lateral opening on the other circumference of the inner sleeve; and a ratchet mechanism disposed within the inner chamber of the inner sleeve and having a first position and a second position such that when the ratchet mechanism is in the first position the inner sleeve lateral opening is fluidly sealed from the outer sleeve lateral opening and when the ratchet mechanism is in the second position the inner sleeve lateral opening is in fluid communication with the outer sleeve at least one lateral opening.

2. The downhole tool of claim 1, wherein the ratchet mechanism has a third position intermediate the first and second positions at which the inner sleeve lateral opening is fluidly sealed from the outer sleeve lateral opening.

3. The downhole tool of claim 1, further comprising a spring biasing the inner sleeve downward.

4. The downhole tool of claim 1, wherein the inner sleeve includes a first slanted surface and further comprising a split valve seat comprising:

first and second halves defining a passageway therethrough; and means for biasing the first and second halves apart;

wherein the first and second halves each define a slanted surface that mates with the first slanted surface as the inner sleeve ratchets downward to overcome the biasing means and push the first and second halves together to seat a ball.

5. The downhole tool of claim 1, wherein the ratchet mechanism includes a plurality of ratchet pawls comprised of an outer arm and an inner arm, the outer arm pivoting upward relative to the inner arm.

6. The downhole tool of claim 1, wherein the ratchet mechanism includes:

a plurality of load pawls; and a plurality of ratchet pawls, each ratchet pawl comprised of:

an inner arm; and an outer arm pivoting upward relative to the inner arm.

7. The downhole tool of claim 6, wherein the ratchet pawls are disposed one half step off the load pawls.

8. An assembly, comprising:

a set of tubing;

a plurality of downhole tools, interspersed along the tubing, each downhole tool comprising:

an outer housing defining an axial bore therethrough and at least one lateral opening;

an inner sleeve slidably disposed coaxially within the axial bore of the outer sleeve and defining an inner chamber and at least one lateral opening; and a ratchet mechanism disposed within the inner chamber of the inner sleeve having a first position and a second position such that when the ratchet mechanism is in the first position the inner sleeve lateral opening is fluidly sealed from the outer housing lateral opening and when the ratchet mechanism is in the second position the inner sleeve lateral opening is in fluid communication with the outer housing lateral opening.

9. The assembly of claim 8, wherein the ratchet mechanism has as third position intermediate the first and second positions at which the inner sleeve lateral opening is fluidly sealed from the outer housing lateral opening.

10. The assembly of claim 8, wherein the inner sleeve includes a first slanted surface and further comprising a split valve seat comprising:

first and second halves defining a passageway therethrough; and means for biasing the first and second halves apart;

wherein the first and second halves each define a slanted surface that mates with the first slanted surface as the inner sleeve ratchets downward to overcome the biasing means and push the first and second halves together to seat a ball.

11. The assembly of claim 8, wherein the ratchet mechanism includes:

a plurality of load pawls; and a plurality of ratchet pawls, each ratchet pawl comprised of:

an inner arm; and an outer arm pivoting upward relative to the inner arm.

12. The assembly of claim 8, further comprising a plurality of packers interspersed along the set of tubing.

13. A method, comprising:

disposing an assembly downhole in a wellbore, the assembly comprising:

a set of tubing;

a plurality of downhole tools, interspersed along the tubing, each downhole tool comprising:

an outer housing defining an axial bore therethrough and at least one lateral opening;

an inner sleeve slidably disposed coaxially within the axial bore of the outer housing and defining an inner chamber and at least one lateral opening;

a ratchet mechanism disposed within inner chamber of the inner sleeve having as first position and a second position such that when the ratchet mechanism is in the first position the inner sleeve lateral opening is fluidly sealed from the outer housing lateral opening and when the ratchet mechanism is in the second position the inner sleeve lateral opening is in fluid communication with outer sleeve housing lateral opening; and a plurality of valve seats, each valve seat functionally associated with a respective one of the downhole tools;

wherein the downhole tools are configured to a closed position upon deployment and indexed to its respective position on the set of tubing relative to the rest of the downhole tools; and dropping a plurality of balls down the wellbore, each ball ratcheting each downhole tool through which it passes closer to an open position.

14. The method of claim 13, further comprising seating each ball in a respective one of the seats as determined by the index of the functionally associated downhole tool as the downhole tool is ratcheted to open the downhole tool.

15. The method of claim 13, wherein each of the seats comprises a portion of the respective downhole tool with which it is functionally associated.

16. The method of claim 15, wherein each inner sleeve includes a first slanted surface and the functionally associated valve seat comprises:

first and second halves defining a passageway therethrough; and means for biasing the first and second halves apart;

wherein the first and second halves each define a slanted surface that mates with the first slanted surface as the inner sleeve ratchets downward to overcome the biasing means and push the first and second halves together to seat a ball.

17. The method of claim 13, further comprising reversing fluid flow through the assembly to unseat the balls.

18. The method of claim 13, wherein the ratchet mechanism has a third position intermediate the first and second positions at which the inner sleeve lateral opening is fluidly sealed from the outer sleeve lateral opening.

19. The method of claim 13, wherein ratchet mechanism includes:

a plurality of load pawls; and a plurality of ratchet pawls, each ratchet pawl comprised of:

an inner arm; and an outer arm pivoting upward relative to the inner arm.

20. The method of claim 19, wherein the ratchet pawls are disposed one half step off the load pawls.

* * * * *